US011342648B2

(12) United States Patent
Uemichi

(10) Patent No.: US 11,342,648 B2
(45) Date of Patent: May 24, 2022

(54) TRANSMISSION LINE AND POST-WALL WAVEGUIDE

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 401 days.

(21) Appl. No.: 16/617,341

(22) PCT Filed: May 29, 2018

(86) PCT No.: PCT/JP2018/020454
§ 371 (c)(1),
(2) Date: Nov. 26, 2019

(87) PCT Pub. No.: WO2018/221485
PCT Pub. Date: Dec. 6, 2018

(65) Prior Publication Data

US 2020/0266516 A1 Aug. 20, 2020

(30) Foreign Application Priority Data

May 30, 2017 (JP) ..... 2017-106913

(51) Int. Cl.
*H01P 3/12* (2006.01)
*H01P 1/16* (2006.01)

(52) U.S. Cl.
CPC . *H01P 3/12* (2013.01); *H01P 1/16* (2013.01)

(58) Field of Classification Search
CPC ..... H01P 3/12; H01P 3/20
See application file for complete search history.

(56) References Cited

U.S. PATENT DOCUMENTS 5,731,751 A 3/1998 Vangala
2009/0243762 A1* 10/2009 Chen ..... H01P 1/2088 333/212

(Continued)

FOREIGN PATENT DOCUMENTS

EP 0883328 A1 12/1998
EP 2958188 A1 12/2015

(Continued)

OTHER PUBLICATIONS

Notification of Transmittal of Copies of Translation of the International Preliminary Report on Patentability (Form PCT/IB/338) of International Application No. PCT/JP2018/020454 dated Dec. 12, 2019 with Forms PCT/IB/373 and PCT/ISA/237. (11 pages).

(Continued)

*Primary Examiner* — Andrea Lindgren Baltzell
*Assistant Examiner* — Jianzi Chen
(74) *Attorney, Agent, or Firm* — WHDA, LLP

(57) ABSTRACT

A transmission line in which a waveguide tube and a planar transmission path are coupled to a post-wall waveguide broadens a band in which return loss is small. A transmission line (1) includes: a PPW (filter 11) including wide walls (13, 14) and narrow walls (16); and a waveguide tube (21). The PPW (filter 11) includes a columnar conductor (pin 18) that passes through an opening (13*a*) which is provided in the wide wall (conductor layer 13) and that has one end portion (181) located inside the substrate (12). The waveguide tube (21) is placed such that the columnar conductor (pin 18) passes through an opening (22*a*) and such that another end portion (182) of the columnar conductor (pin 18) is located inside the waveguide tube (21).

11 Claims, 7 Drawing Sheets

(56) References Cited

U.S. PATENT DOCUMENTS

| | | | | |
|---|---|---|---|---|
| 2016/0293557 | A1* | 10/2016 | Topak | H01P 3/14 |
| 2016/0372373 | A1* | 12/2016 | Asahi | H01L 23/49827 |
| 2021/0091442 | A1* | 3/2021 | Uemichi | H01P 1/2088 |
| 2021/0124111 | A1* | 4/2021 | Uemichi | G02B 6/02052 |

FOREIGN PATENT DOCUMENTS

| | | | |
|---|---|---|---|
| GB | 2497982 | A | 7/2013 |
| JP | 6140872 | A | 5/1994 |
| JP | 6190932 | A | 7/1994 |
| JP | 2005-102024 | A | 4/2005 |
| JP | 2015-080100 | A | 4/2015 |
| JP | 2015-226109 | A | 12/2015 |
| JP | 2016-006918 | A | 1/2016 |

OTHER PUBLICATIONS

International Search Report dated Jun. 25, 2018, issued in counterpart application No. PCT/JP2018/020454. (1 page).

* cited by examiner

Post walls 16 (narrow walls): side walls 161 and 162; and short walls 163 and 164
MSL 20: signal line 20s; and ground layer (conductor layer 13)

MSL 20: signal line 20s; and conductor film 13

Filter 411: including substrate 412 and conductor layers 413 and 414
Tube wall 422: including upper wall 4221 and lower wall 4222

TRANSMISSION LINE AND POST-WALL WAVEGUIDE

TECHNICAL FIELD

The present invention relates to a transmission line in which a post-wall waveguide and a waveguide tube are coupled to each other. The present invention also relates to a post-wall waveguide capable of being coupled to the waveguide tube.

BACKGROUND ART

In a wireless device that is designed to operate in a microwave band or in millimeter wave band, a passive device constituted by a post-wall waveguide (PWW) is used. In the PWW, a region which is rectangular in cross-sectional shape and is surrounded by a pair of conductor layers provided on respective opposite surfaces of a substrate made of a dielectric and by a post wall constituted by a plurality of conductor posts which are placed inside the substrate in a fence-like manner, functions as a propagation region through which electromagnetic waves propagate.

Note that since the substrate which is a constituent member of the PWW is small in thickness, the width of the pair of conductor layers in a cross section of the propagation region is greater than the height of the post wall (equal to the thickness of the substrate) in the cross section. Thus, in the PWW, the pair of conductor layers is also called a pair of wide walls, and the post wall is also called narrow walls. In a case where directions parallel to a normal to the pair of wide walls are referred to as upper and lower directions, directions parallel to a direction of propagation of electromagnetic waves is referred to as anterior and posterior directions, directions orthogonal to the upper and lower directions and to the anterior and posterior directions are referred to as left and right directions, the pair of wide walls surrounds the propagation region from the upper and lower directions, the narrow walls surround the propagation region from the anterior and posterior directions and from the left and right directions. Note that, of all the narrow walls, narrow walls surrounding the propagation region from the left and right directions are also referred to as side walls, and narrow walls surrounding the propagation region from the anterior and posterior directions are also referred to as short walls.

As members of a transmission line, other than the PWW configured as described above, which members are coupled to the PWW, are considered a waveguide tube made of a metal and a planar transmission line typified by a microstrip line (MSL) and a coplanar line.

Patent Literatures 1 to 3 each disclose, as described below, transmission lines in which a waveguide tube is coupled to one end portion of the PWW, and an MSL is coupled to another end portion of the PWW.

In the transmission line illustrated in FIGS. 1 to 4 of Patent Literature 1 (in Patent Literature 1, the transmission line is described as "connection structure"), a coupling window is provided by omitting a short wall of the PWW, and part of the short wall in the waveguide tube is opened (in Patent Literature 1, the short wall is described as "closure structure"). In this transmission line, the open part of the short wall in the waveguide tube face the coupling window of the PWW so that the PWW and the waveguide tube are coupled to each other.

In the transmission line illustrated in FIGS. 1 to 3 of Patent Literature 2 (in Patent Literature 2, the transmission line is described as "transmission ode converting device"), the PWW and the waveguide tube are placed in such a manner that they share a conductor layer provided on one surface of the substrate. This conductor layer functions as one wide wall of the PWW and also functions as one wide wall of the waveguide tube (see FIG. 3). To the wide wall shared by the PWW and the waveguide tube are provided four rectangular coupling windows. In this transmission line, the PWW and the waveguide tube are coupled to each other via these four coupling windows.

In the transmission line illustrated in FIGS. 1 and 2 of Patent Literature 3, a coupling window is provided in one wide wall of the PWW, and a short wall of the waveguide tube is opened. In this transmission line, a part of the wide wall where the coupling window is provided in the PWW faces an open cross section of the short wall of the waveguide tube so that the PWW and the waveguide tube are coupled to each other.

Further, the transmission lines disclosed in Patent Literatures 1 to 3 employ an MSL as a planar transmission path to be coupled to an end portion of the PWW on a side away from another end portion thereof on a side to which the waveguide tube is connected, wherein the MSL includes a signal line and a ground layer. Those transmission lines include a columnar conductor (for example, in Patent Literature 3, the columnar conductor is described as a power feeding pin) that converts a mode of propagating through the inside of the PWW into a mode of propagating through the inside of the MSL. This columnar conductor couples the PWW and the waveguide tube.

CITATION LIST

Patent Literature

[Patent Literature 1]
Japanese Patent Application Publication Tokukai No. 2015-80100

[Patent Literature 2]
Japanese Patent Application Publication Tokukai No. 2015-226109

[Patent Literature 3]
Japanese Patent Application Publication Tokukai No. 2016-6918

SUMMARY OF INVENTION

Technical Problem

The above-described transmission lines as disclosed in Patent Literatures 1 to 3 are required to have small return loss (e.g., return loss of −15 dB or less) over a wide band (e.g., in the case of operation in the E-band, not less than 71 GHz to not more than 86 GHz).

For example, in a case where −15 dB is set as a threshold value against which to judge return loss, the bandwidths of all of the transmission lines disclosed in Patent Literatures 1 to 3 are less than 10 GHz (see FIG. 9 of Patent Literature 1, FIG. 13 of Patent Literature 2, and FIG. 4 of Patent Literature 3). These bandwidths are not sufficient, and the conventional transmission lines have room for broadening of the band.

The present invention has been made in view of the above problem, and it is an object of the present invention to broaden a band in which return loss is small in a transmission line in which a waveguide tube and a planar transmission path are coupled to a PWW.

Solution to Problem

In order to solve the above problem, a transmission line in accordance with a aspect of the present invention includes: (A) a post-wall waveguide including a substrate made of a dielectric, a pair of wide walls being constituted by a first conductor layer and a second conductor layer, respectively, and covering respective opposite surfaces of the substrate, and narrow walls being constituted by post walls which are provided inside the substrate; and (B) a waveguide tube comprising a tube wall made of a conductor and being placed along the substrate.

The post-wall waveguide further includes: a planar transmission path including a ground layer which is a portion of the first conductor layer or a portion of the second conductor layer; a converting section which converts between a mode propagating through the planar transmission path and a mode of propagating through the post-wall waveguide; and a first columnar conductor passing through an opening which is provided in the first conductor layer, the first columnar conductor having one end portion located inside the substrate.

The waveguide tube is placed such that the first columnar conductor passes through an opening which is provided in the tube wall and such that another end portion of the first columnar conductor located inside the waveguide tube.

In order to solve the above problem, a post-wall waveguide in accordance with an aspect of the present invention includes: a substrate made of a dielectric; a pair of wide walls being constituted by a first conductor layer and a second conductor layer, respectively, and covering respective opposite surfaces of the substrate; narrow walls being constituted by post walls which are provided inside the substrate; a planar transmission path including a ground layer which is a portion of the first conductor layer or a portion of the second conductor layer; a converting section which converts between a mode of propagating through the planar transmission path and a mode of propagating through a region surrounded by the pair of wide walls and the narrow walls; and a first columnar conductor passing through an opening which is provided in the first conductor layer, the first columnar conductor having one end portion which is located inside the substrate and another end portion which protrudes to an outside of the substrate.

Advantageous Effects of Invention

A transmission line in accordance with an aspect of the present invention can broaden a band in which return loss is small.

Figure 1:
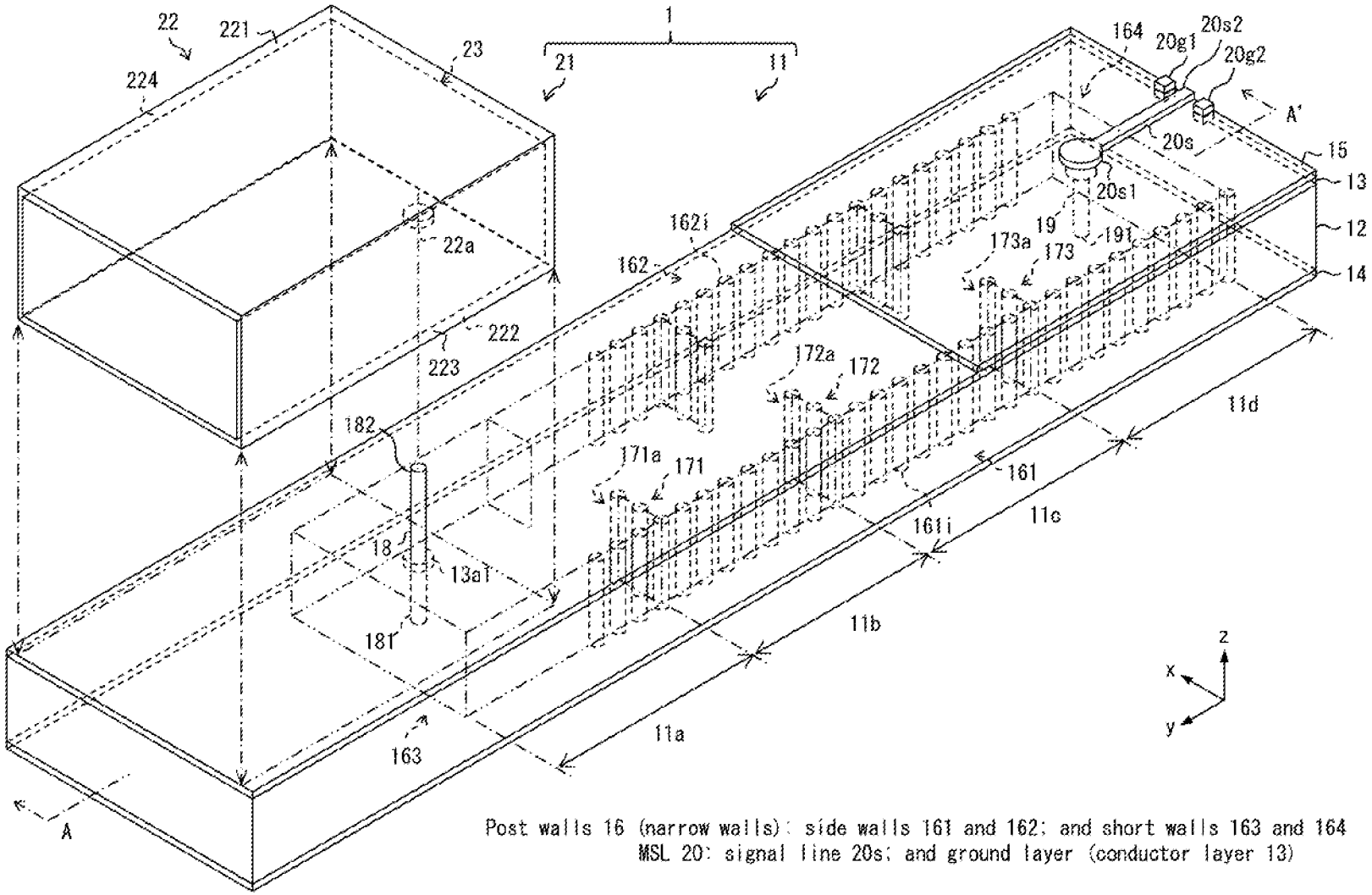
FIG. 1 is an exploded perspective view illustrating transmission line in accordance with Embodiment 1 of the present invention.
Figure 2:
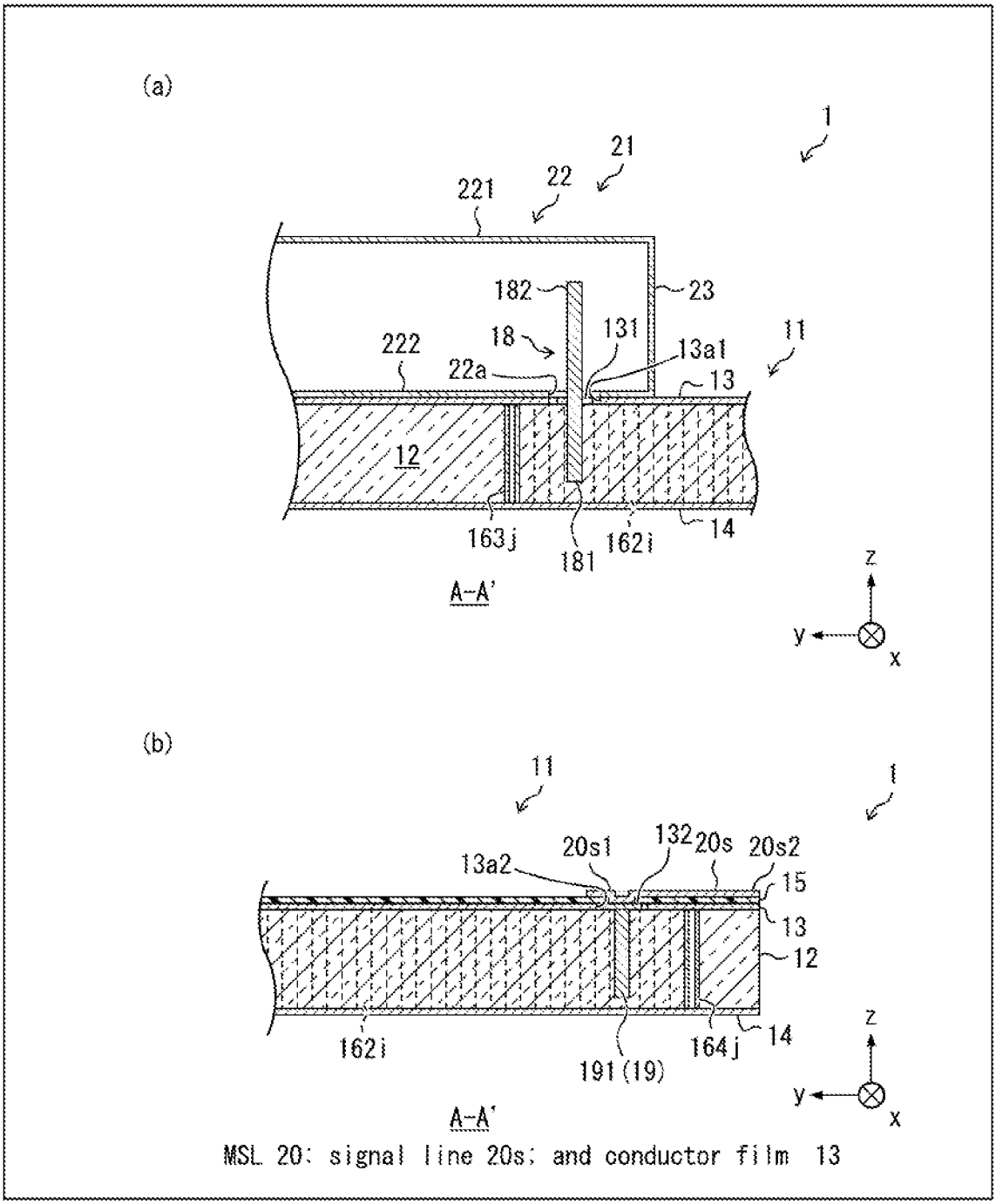

(a) of FIG. 2 is a cross-sectional view illustrating a PWW-waveguide tube converting section included in the transmission line illustrated in FIG. 1. (b) of FIG. 2 is a cross-sectional view illustrating PWW-MSL converting section included in the transmission line illustrated in FIG. 1.

Figure 3:
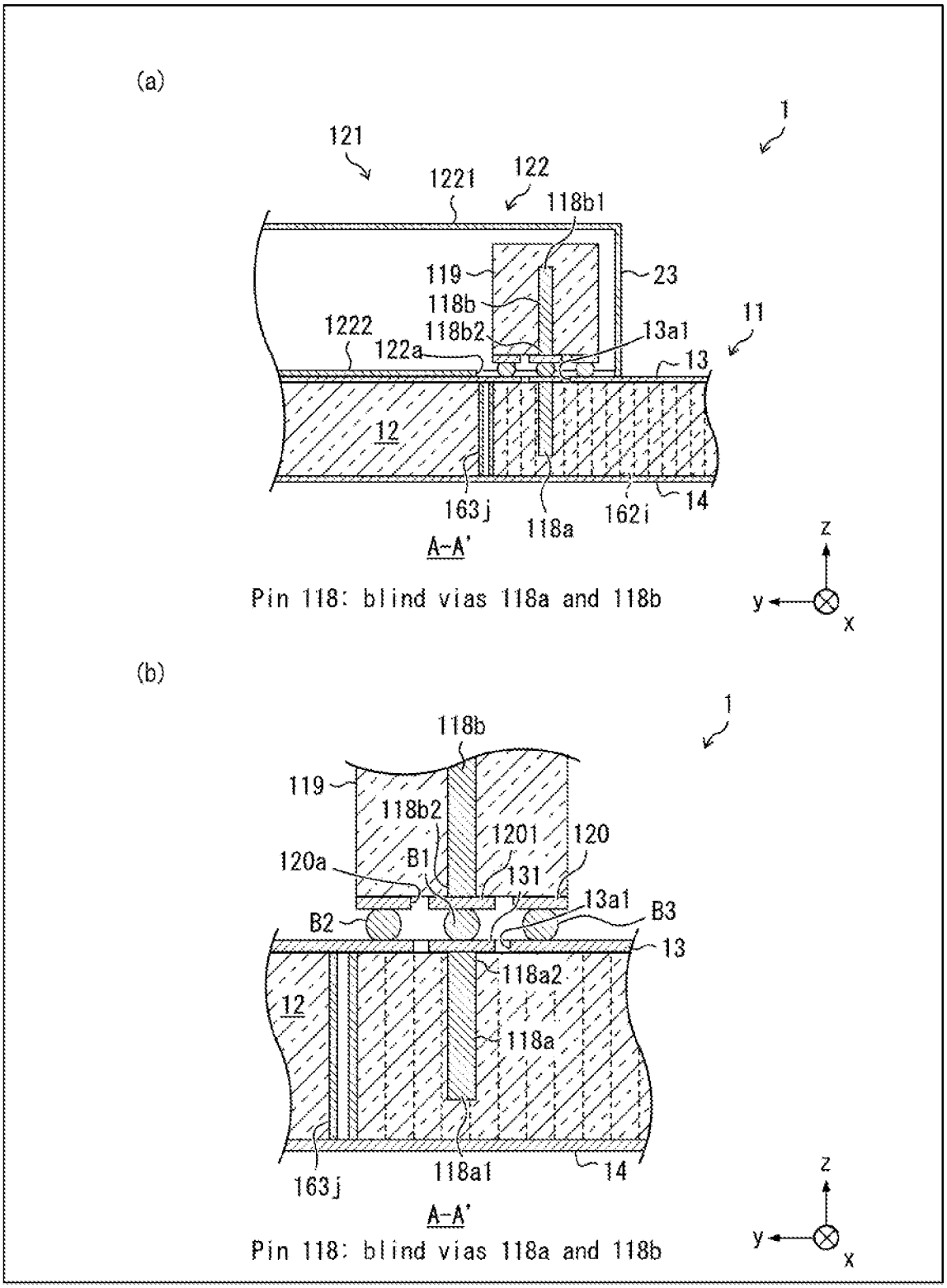

(a) of FIG. 3 is a cross-sectional view illustrating a transmission line that includes a variation of the PWW-waveguide tube converting section illustrated in (a) of FIG. 2. (b) of FIG. 3 is an enlarged cross-sectional view illustrating a PWW-waveguide tube converting section illustrated in (a) of FIG. 3.

Figure 4:
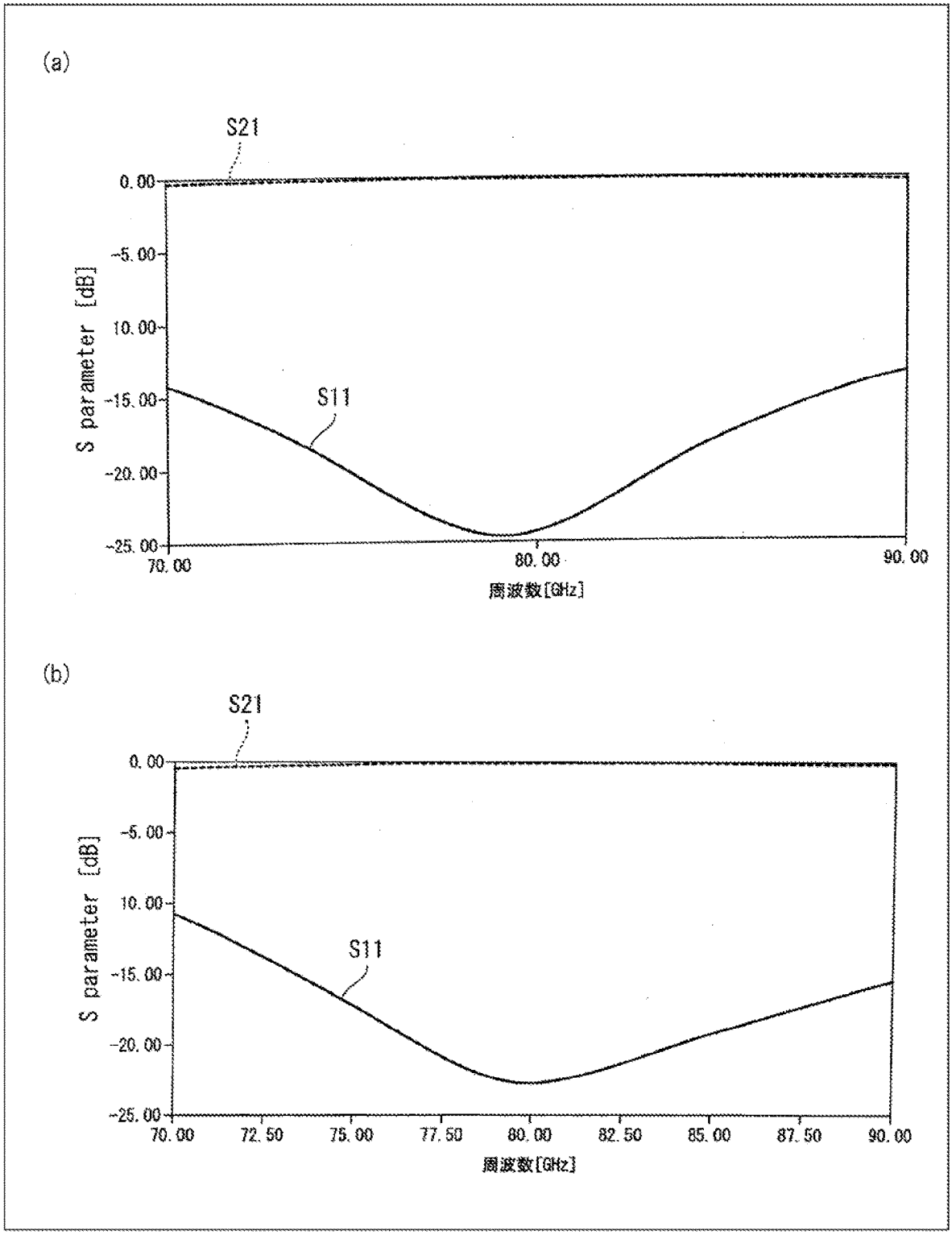

(a) of FIG. 4 is a graph showing reflection characteristics and transmission characteristics of a transmission line in Example 1 of the present invention. (b) of FIG. 4 is a graph showing reflection characteristics and transmission characteristics of a transmission line in Example 2 of the present invention.

Figure 5:
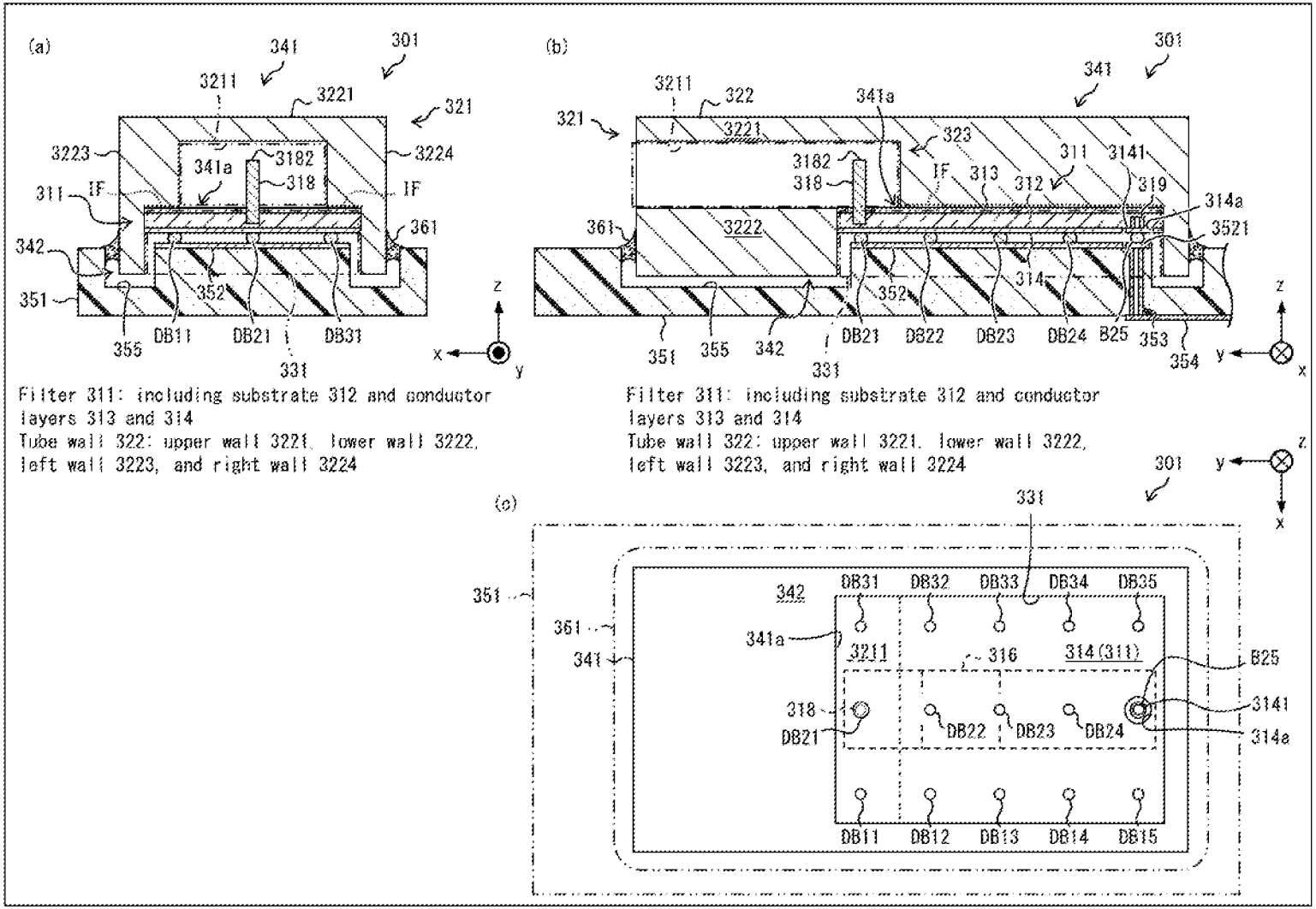

(a) and (b) of FIG. 5 are each a cross-sectional view illustrating a transmission line in accordance with Embodiment 2 of the present invention. (c) of FIG. 5 is a plan view illustrating the transmission line illustrated in (a) and (b) of FIG. 5.

Figure 6:
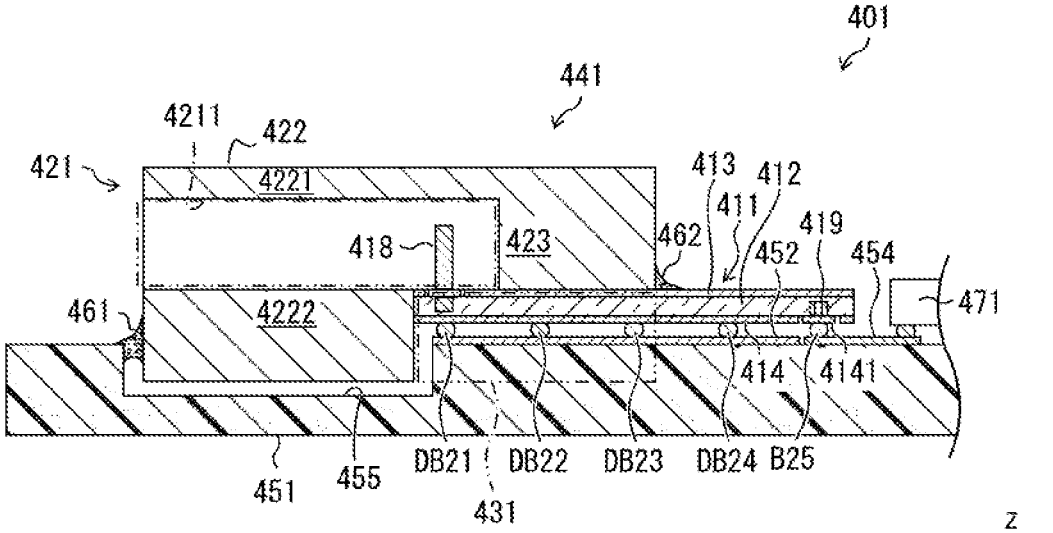
Figure 6:
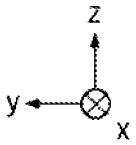

FIG. 6 is a cross-sectional view illustrating a variation of the transmission line illustrated in FIG. 5.

Figure 7:
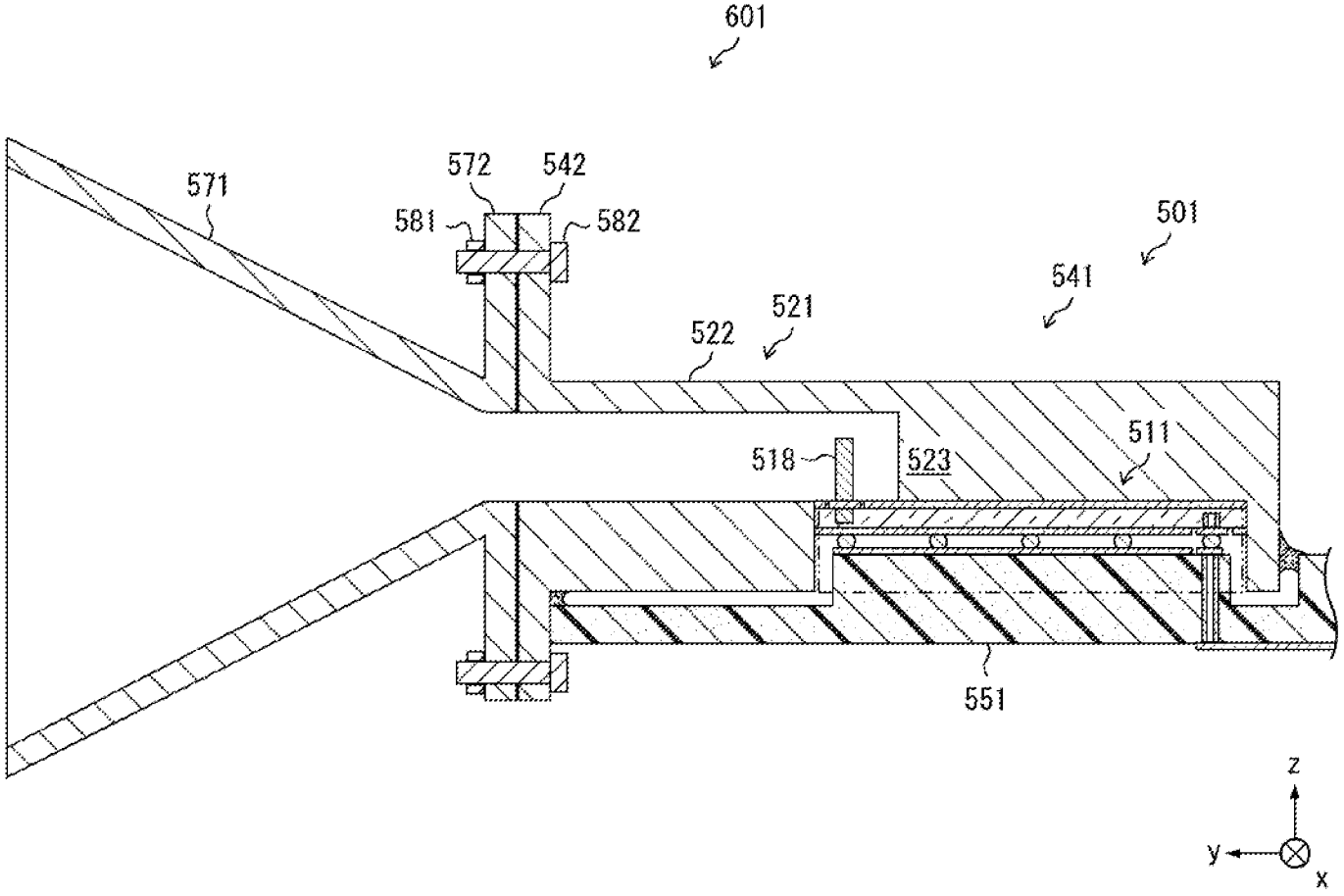

FIG. 7 is a cross-sectional view illustrating a transmission line in accordance with Embodiment 3 of the present invention.

DESCRIPTION OF EMBODIMENTS

A transmission line in accordance with an aspect of the present invention is a transmission line obtained by coupling (i) a passive device constituted by a post-wall waveguide (PWW) and (ii) a waveguide tube made of a conductor. Examples of the passive device include a distributor, a filter, a directional coupler, and a diplexer. In Embodiments 1 to 3 below, a filter is employed as the passive device. However, the type of a passive device constituting a part of a transmission line in accordance with an aspect of the present invention is not limited to any particular type, and the passive device may be a distributor, a directional coupler, a diplexer, or the like.

A transmission line in accordance with an aspect of the present invention is designed to be operated in the E-band (band of not less than 70 GHz to not more than 90 GHz).

Embodiment 1

A transmission line in accordance with Embodiment 1 of the present invention will be described with reference to FIGS. 1 and 2. FIG. 1 is an exploded perspective view illustrating a transmission line 1 in accordance with Embodiment 1. (a) of FIG. 2 is a cross-sectional view illustrating a PWW-waveguide tube converting section included in the transmission line 1. (b) of FIG. 2 is a cross-sectional view illustrating a PWW-MSL converting section included in the transmission line 1.

In orthogonal coordinate systems illustrated in FIGS. 1 and 2, a y-axis is set to a direction of propagation of electromagnetic waves in the filter 11 and the waveguide tube 21, a z-axis is set to a direction normal to a surface of a substrate 12, and an x-axis is set to a direction orthogonal to the y-axis and the z-axis.

Note that, in the present specification, in accordance with the orientation of the transmission line 1 arranged as illustrated in FIG. 1, a z-axis positive (negative) direction is referred to as an upper (lower) direction, an x-axis positive (negative) direction is referred to as a left (right) direction, and a y-axis positive (negative) direction is referred to as an anterior (posterior) direction. Further, in a case where no specification of whether a positive direction or a negative direction is made, a z-axis direction is referred to as upper and lower directions, an x-axis direction is referred to as left and right directions, and an x-axis direction is referred to as anterior and posterior directions.

As illustrated in FIG. 1, the transmission line 1 includes (i) the filter 11 constituted by a PWW and (ii) the waveguide tube 21.

(Filter 11)

The filter 11 is a laminate substrate in which a conductor layer 13 and a conductor layer 14 are provided on opposite sides of a substrate 12 made of a dielectric (made of quartz glass in Embodiment 1). The conductor layer 13 and the conductor layer 14 are, respectively, first conductor layer and a second conductor layer recited in the claims. Note that the substrate 12 need only be made of a dielectric, and the dielectric which constitutes the substrate 12 may be selected as appropriate in consideration of at least one of a relative dielectric constant, processability, and the like.

Inside the substrate 12 are provided post walls obtained by arranging a plurality of conductor posts 161*i*, 162*i*, 163*j*, and 164*j* (where i and j are any positive integers) in a fence-like manner (for the conductor posts 163*j* and 164*j*, see FIG. 2).

The plurality of conductor posts 161*i*, 162*i*, 163*j*, and 164*j* are obtained by charging a conductor such as a metal into vias, which are formed so as to pass through the substrate 12 from the front surface to the rear surface of the substrate 12, or by depositing the conductor on internal surfaces of the vias. All of the plurality of conductor posts 161*i*, 162*i*, 163*j*, and 164*j* electrically connect the conductor layer 13 and the conductor layer 14. Note that a diameter of the conductor posts 161*i*, 162*i*, 163*j*, and 164*j* may be set as appropriate according to the operation band. In Embodiment 1, the diameter of the conductor posts 161*i*, 162*i*, 163*j*, and 164*j* is 100 μm. Further, an interval between adjacent ones of the conductor posts 161*i*, an interval between adjacent ones of the conductor posts 162*i*, an interval between adjacent ones of the conductor posts 163*j*, and an interval between adjacent ones of the conductor posts 164*j* are each 100 μm, which is equal to the diameter of the conductor posts 161*i*, 162*i*, 163*j*, and 164*j*.

A side wall 161, which is a post wall obtained by arranging the plurality of conductor posts 161*i* at predetermined spacial period in a fence-like manner, functions as a kind of conductor wall that reflects electromagnetic waves in a band corresponding to the spacial period.

Similarly, a post wall obtained by the plurality of conductor posts 162*i* constitutes a side wall 162, a post wall obtained by the plurality of conductor posts 163*j* constitutes a short wall 163, and a post wall obtained by the plurality of conductor posts 164*j* constitutes a short wall 164. Further, the side walls 161 and 162 and the short walls 163 and 164 are collectively referred to as narrow walls 16. Individual plane surfaces represented by imaginary lines (two-dot chain lines) illustrated in FIG. 1 are imaginary plane surfaces each including corresponding ones of central axes of the plurality of conductor posts 161*i*, 162*i*, 163*j*, and 164*j*, and are plane surfaces each schematically representing a conductor wall which is imaginarily realized by a corresponding one of the side walls 161 and 162 and the short walls 163 and 164.

Note that FIG. 1 omits some of the conductor posts 161*i*, some of the conductor posts 162*i*, and all of the conductor posts 163*j* and 164*j*, for ease of viewing of the configuration of the PWW-waveguide tube converting section (described later) and the configuration of the PWW-MSL converting section (described later).

As illustrated in FIG. 1, the narrow walls 16 surround a rectangular parallelepiped-shaped region from the anterior and posterior directions and from the left and right directions. Further, the conductor layer 13 and the conductor layer 14, which are a pair of wide walls, surround the rectangular parallelepiped-shaped region from the upper and lower directions, respectively. Electromagnetic waves propagate through a propagation region, i.e. the rectangular parallelepiped-shaped region, in the y-axis direction of the propagation region. Thus, the PWW is constituted by a pair of wide walls and narrow walls.

In Embodiment 1, the above-described rectangular parallelepiped-shaped propagation region is divided into a resonator 11*a*, a resonator 11*b*, a resonator 11*c*, and a resonator 11*d* by partition walls 171, 172, and 173. Note that, as with the narrow walls 16, the partition walls 171, 172, and 173 are constituted by post walls.

Although the partition wall 171 is constituted by the conductor posts, no conductor posts are provided in and near a center of the partition wall 171. Thus, the conductor posts are not provided in some area of the post walls, and such an area functions as a coupling window 171*a* through which the resonator 11*a* and the resonator 11*b*, adjacent to each other, are electromagnet coupled.

Similarly, through a coupling window 172*a* provided in and near the center of the partition wall 172, the resonator 11*b* and the resonator lie are coupled. Through a coupling window 173*a* provided in and near the center of the partition wall 173, the resonator 11*c* and the resonator 11*d* are coupled.

The filter 11 configured by electromagnetically coupling the resonators 11*a* to 11*d* in this manner is a resonator-coupled filter.

(Waveguide Tube 21)

The waveguide tube 21 is made of a conductor Embodiment 1, a brass surfaced with gold plating). As illustrated in FIG. 1, the waveguide tube 21 includes a tube wall 22, which is rectangular in cross section, and a short wall 23. The short wall 23 seals an end portion (end portion on a y-axis negative direction side) of the tube wall 22. That is, the waveguide tube 21 is a rectangular waveguide tube. The tube wall 22 has a wide wall 291 and a wile wall 222, which are a pair of wide walls, and a narrow wall 223 and a narrow wall 224, which are a pair of narrow walls.

Out of the pair of wide walls, the wide wall 222 located on a filter 11 side (on a z-axis negative direction side) has an opening 22*a*, which is larger in diameter than a pin 18 (described later).

To couple the filter 11 and the waveguide tube 21, the waveguide tube 21 is brought close to the filter 11 in the z-axis negative direction from a disassembled state illustrated in FIG. 1, and the waveguide tube 21 is placed on the filter 11 in such a manner that the pin 18 passes through the opening 22*a*, and a lower surface of the wide wall 222 comes into close contact with an upper surface of the conductor layer 13 without any gap between them.

In the transmission line 1 configured as described above, the waveguide tube 21 is electromagnetically coupled to the filter 11 via the pin 18. Thus, the pin 18 is a PWW-waveguide tube converting section through which the filter 11, which is constituted by PWW, and the waveguide tube are coupled. The PWW-waveguide tube converting section will be described in detail later with reference to (a) of FIG. 2.

In Embodiment 1, an end portion (end portion on a y-axis positive direction side) of the waveguide tube 21 on a side facing away from the short wall 23 is trimmed off so as to be flush with an end face of the substrate 12 on the y-axis positive direction side. However, the end portion of the waveguide tube 21 on the y-axis positive direction side may further extend toward the y-axis positive direction side, without being trimmed off. Further, as described later with reference to FIG. 7, the end portion of the waveguide tube 21 on the y-axis positive direction side may be coupled to a device, such as art antenna, which is suitable to be coupled with use of a waveguide tube.

Note that, in Embodiment 1, the waveguide tube 21 is left hollow inside. Instead of having such a hollow structure, the waveguide tube 21 may be configured such that dielectric particles for adjusting a relative dielectric constant are charged into the waveguide tube 91.

(PWW-Waveguide Tube Converting Section)

A cross-sectional view of a cross section taken along line A-A' in FIG. 1 (a cross section along a y-z plane surface) is illustrated in FIG. 2. (a) of FIG. 2 is a cross-sectional view illustrating the vicinity of the pin 18.

As illustrated in (a) of FIG. 2, a portion of the conductor layer 13 is cut out in the shape of a ring in the vicinity of the conductor posts 163*j* (conductor posts constituting the short wall 163) in the propagation region of the filter 11. As a result, the conductor layer 13 is provided with an opening 13*a*1. Inside the opening 13*a*1 is provided a land 131 (not illustrated in FIG. 1) which is concentric with the opening 13*a*1. Further, a circular opening is provided in and near the center of the land 131 (preferably in the center of the land 131), and the substrate 12 has a cylindrical pore which communicates with the circular opening and extends from a surface of the substrate 12 (the surface on a z-axis positive direction side) to the inside of the substrate 12. As illustrated in (a) of FIG. 2, the pore is a non-through-hole.

The pin 18 (first columnar conductor recited in the claims) made of a metal is secured to the substrate 12 by being inserted into the opening and pore of the land 131 described above. The pin 18 being inserted into the substrate 12 in this way passes through the opening 13*a*1, and a lower end portion 181 of the pin 18 (one end portion recited in the claims) is located inside the substrate 12, i.e. in the propagation region of the filter 11. Further, an upper end portion 182 (another end portion recited in the claims) of the pin 18 being secured in this way is located inside the waveguide tube 21, i.e. in the propagation region of the waveguide tube 21.

The diameter of the pin 18, the length of the pin 18 (length along the z-axis direction), the length of a portion of the pin 18 inserted into the substrate 12, and the length of a portion of the pin 18 protruding through the surface of the substrate 12 can be used as design parameters for optimizing return loss. For example, in Embodiment 1, 180 μm is employed as the diameter of the pin 18.

Note that the end portion 182 of the pin 18 is not in electrical communication with the wide wall 221. The length of the portion of the pin 18 protruding through the substrate 12 can be adjusted within the bounds of the end portion 182 not contacting the wide wall 221.

In a case where electromagnetic waves propagating through the propagation region of the filter 11 in the y-axis positive direction are present, the portion of the pin 18 inserted into the substrate 12 draws the electromagnetic waves which have propagated through the propagation region of the filter 11, and the portion of the pin 18 protruding through the substrate 12 radiates the electromagnetic waves into the propagation region of the waveguide tube 21. Similarly, in a case where electromagnetic waves propagating through the propagation region of the waveguide tube 21 in the y-axis negative direction are present, the portion of the pin 18 protruding through the substrate 12 draws the electromagnetic waves from the propagation region of the waveguide tube 21, and the portion of the pin 18 inserted into the substrate 12 radiates the electromagnetic waves into the propagation region of the filter 11. Thus, the pin 18 functions as the PWW-waveguide tube converting section.

As described above, the pin 18 electromagnetically couples a mode of propagating through the propagation region of the filter 11 and a mode of propagating through the propagation region of the waveguide tube 21. The coupling between the filter 11 and the waveguide tube 21 via the pin 18 is provided over a wide band, in comparison to coupling with use of the conventional coupling window. Thus, the transmission line 1 including the pin 18 can reduce return loss at a coupling section between the filter 11 and the waveguide tube 21 over a wide band, in comparison to the conventional transmission device. Thus, the transmission line 1 can broaden a band in which return loss is small, in comparison to the conventional transmission line.

(PWW-MSL Converting Section)

(b) of FIG. 2 is a cross-sectional view illustrating the vicinity of a blind via 19.

As in the case of the opening 13*a*1 illustrated in (a) of FIG. 2, an opening 13*a*2 is provided in the conductor layer in the vicinity of the conductor post 164*j* in the propagation region of the filter 11. Inside the opening 13*a*2, a land 132 is provided. Further, a cylindrical pore is provided in and near the center of the land 132 (preferably in the center of the land 132). The pore is a non-through-hole. The blind via 19 is obtained by charging a conductor such as a metal into the non-through-hole or by depositing the conductor on an internal surface of the non-through-hole. The blind via 19 has a lower end portion 191 (one end portion recited in the claims) located inside the substrate 12, i.e. in the propagation region of the filter 11. Further, the blind via 19 has an upper end portion (another end portion recited in the claims) which is in electrical communication with the land 132.

Further, a dielectric layer 15 made of a dielectric is provided on a surface of the conductor layer 13 on a side facing away from the substrate 12, and a signal line 20*s* made of a long narrow conductor is provided on a surface of the dielectric layer 15 on a side facing away from the conductor layer 13.

An end portion 20*s*1 of the signal line 20*s* is an end portion on the y-axis positive direction side of the signal line 20*s*, and is located inside the propagation region of the filter 11 when the filter 11 is viewed in a plan view. The end portion 20*s*1 is in electrical communication with the land 132. Thus, the blind via 19 and the signal line 20*s* are in electrical communication with each other via the land 132.

The signal line 20*s* and conductor layer 13 both of which are configured as above constitute a microstrip line (MSL) 20 in which the conductor layer 13 serves as a ground layer. Besides, the blind via 19 electromagnetically couples a mode of propagating through the propagation region of the filter 11 and a mode of propagating through the propagation region of the MSL 20. In other words, the blind via 19 functions as the PWW-MSL converting section.

Further, as illustrated in FIG. 1, a ground pad 20*g*1 and a ground pad 20*g*2 are disposed in the vicinity of the end portion 20*s*2 of the signal line 20*s*. Each of the ground pad 20*g*1 and the ground pad 20*g*2 is a conductor pad made of a metal, and a metal is charged into the opening provided in the dielectric layer 15. Thus, the ground pad 20*g*1 and the ground pad 20*g*2 are in electrical communication with the conductor layer 13, which serves as a ground layer.

In a ground-signal-ground electrode structure configured as described above, a circuit such as a radio frequency integrated circuit (RFIC) can be easily mounted.

Note that in Embodiment 1, as illustrated in (b) of FIG. 2, an end portion 20*s*2 of the signal line 20*s* is an end portion on the y-axis negative direction side of the signal line 20*s*, and is located outside the propagation region of the filter 11 when the filter 11 is viewed in a plan view. However, the length of the signal line 20*s* can be set to any length. In a case where the length of the signal line 20*s* is shorter, the end portion 20*s*2 may be placed inside the propagation region when the filter 11 is viewed in a plan view. Further, in Embodiment 1, the signal line 20*s* extends from the end portion 20*s*1 in the y-axis negative direction. However, the signal line 20*s* may extend from the end portion 20*s*1 in the y-axis positive direction.

As described above, the waveguide tube 21 is coupled to one end portion of the filter 11, while the MSL 20, which is an example of a planar transmission path, is coupled to another end portion of the filter 11. This allows the filter 11 to couple the waveguide tube 21 and the MSL 20 with small return loss over a wide band. Thus, the transmission line 1 can be suitably used as a transmission line for coupling an antenna and an RFIC with use of the filter 11. Note that the planar transmission path coupled to the filter 11 is not limited to an MSL and may be a coplanar line.

Note that, as described earlier, the filter 11 illustrated in FIGS. 1 and 2 can be easily coupled to the waveguide tube 21 with use of the waveguide tube 21 having the tube wall 22 with the opening 22*a*. Specifically, it is possible to couple the filter 11 and the waveguide tube 21 by passing the pin 18 through the opening 22*a* provided in the waveguide tube 21 and by placing the waveguide tube 21 such that the end portion 182 of the pin 18 is located inside the waveguide tube 21.

A coupling section, provided in this way, between the filter 11 and the waveguide tube 21 can reduce return loss over a wide band. Thus, the filter 11 is also included in the technical scope of the present invention.

[Variation of Pin 18]

A pin 118, which is a variation of the pin 18, will be described with reference to FIG. 3. (a) of FIG. 3 is a cross-sectional view illustrating a transmission line 1 including the pin 118. (b) of FIG. 3 is an enlarged cross-sectional view illustrating the pin 118.

In the transmission line 1 illustrated in FIG. 3, the pin 18 included in the transmission line 1 illustrated in FIGS. 1 and 2 is replaced by the pin 118, and the waveguide tube 21 included in the transmission line 1 illustrated in FIGS. 1 and 2 is replaced by a waveguide tube 121. In the present variation, only different features of the transmission line 1 illustrated in FIG. 3, as compared with the features of the transmission line 1 illustrated in FIGS. 1 and 2, will be described.

The pin 118 is divided into a blind via 118*a*, which is a first part, and a blind via 118*b*, which is a second part.

The blind via 118*a* is structured in the same manner as the blind via 19 illustrated in (b) of FIG. 2, a lower end portion 118*a*1 (end portion on the z-axis negative direction side) is located inside the substrate 12, and an upper end portion 118*a*2 (end portion on the z-axis positive direction side) reaches the surface of the substrate 12. Further, the end portion 118*a*2 of the blind via 118*a* is connected to a land 131 in a state of being in electrical communication with the land 131.

The blind via 118*b* is embedded in a block 119 made of a dielectric (made of quartz glass in Embodiment 1), an upper end portion 118*b*1 (end portion on the z-axis positive direction side) is located inside the block 119, and a lower end portion 118*b*2 (end portion on the z-axis negative direction side) reaches the surface of the block 119.

The blind via 118*b* can be produced as follows: A substrate used as the block 119 is a substrate (i) having a thickness smaller than a distance between the wide walls 1221 and 1222 of the waveguide tube 121, (ii) being made of a dielectric (made of quartz glass in Embodiment 1), and (iii) having a conductor layer 120 formed on one surface (surface on the z-axis negative direction side in FIG. 3) of the substrate. A plurality of blind vias are formed in a matrix manner on the substrate having the conductor layer 120 formed thereon. Then, by cutting the substrate having the plurality of blind vias formed thereon into cubes, the block 119 having the blind via 118*b* formed thereon is obtained. Then, by cutting out a portion of the conductor layer 120 in a ring shape, (i) a land 1201 which is in electrical communication with the blind via 118*b* and (ii) the conductor layer 120 surrounding the land 1201 while being spaced away from the land 1201 are formed on the surface of the block 119.

As illustrated in (b) of FIG. 3, the land 1201 is connected to the land 131 with use of a bump B1. The conductor layer 120 is connected to the conductor layer 13 with use of bumps B2 and B3. The bumps B1 to B3, which are an aspect of an electrically conductive connecting member, are each obtained by forming a solder layer on a surface of a metallic spherical member. In this manner, the blind via 118*b* is connected and secured to the blind via 118*a*.

Here, to reduce return loss as much as possible, it is preferable that a central axis of the blind via 118*a* be coaxial (coincide) with a central axis of the blind via 118*b*.

The electrically conductive connecting member may be a solder, an electrically conductive adhesive (e.g., silver paste), or the like as an alternative to the bumps. However, by employing the bumps B1 to B3 having a uniform diameter as the electrically conductive connecting member, it is possible to easily enhance parallelism between the surface of the substrate 12 on which the conductor layer 13 is formed and the surface of the block 119 on which the conductor layer 120 is formed. Thus, it is easy to connect the blind via 118*a* and the blind via 118*b* in a state in which the central axis of the blind via 118*a* and the central axis of the blind via 118*b* are parallel to each other.

In the case of the pin 18, a cylindrical pore having a predetermined diameter (e.g., 180 μm) is provided in advance on the substrate 12 at a predetermined position, and the pin 18 is inserted into the pore so that the pin 18 is secured to the substrate 12. In this case, the diameter of the pore needs to be precisely formed. The predetermined diameter is defined with a certain margin (tolerance). However, in a case where the diameter of a provided pore is smaller than the predetermined diameter, the pin 18 cannot be inserted into the substrate. In a case where the diameter of a provided pore is larger than the predetermined diameter, the pin 18 cannot be firmly secured to the substrate.

Further, the pin 18, which is a very thin columnar conductor, tends to bend when inserted into the pore. Therefore, the operation of inserting the pin 18 into the substrate 12 needs to be done with a high degree of precision, regardless of whether when a person carries out the operation by hand or when a manipulator controlled by a machine is used to carry out the operation.

On the contrary, in the case of the pin 118, the blind via 118*a* and the blind via 118*b* can be connected easily and accurately with use of the electrically conductive connecting member such as the bumps B1 to B3. Thus, the transmission line 1 with the pin 118 can be easily produced in comparison with the transmission line 1 with the pin 18.

Further, the configuration in which the blind via 118*b*, which is the second part, is embedded in the block 119 provides ease of handling in comparison with a configuration in which the second part is merely a columnar conductor (a configuration in which the blind via 118*b* is not embedded in the block 119). Thus, the transmission line 1 with the pin 118 can be produced more easily.

With the pin 118 embedded in the block 119, a size of an opening 122*a* (see (a) of FIG. 3) provided on the wide wall 1222 of the waveguide tube 121 is larger than the opening 22*a* (see (a) of FIG. 2). Specifically, when the transmission line 1 is viewed in a plan view, the size of the opening 122*a* is increased so as to encompass the block 119. With such a configuration, the waveguide tube 21 can be placed easily at a predetermined position even when the pin 118 is embedded in the block 119.

EXAMPLES

Example 1

As Example 1 of the present invention, reflection characteristics and transmission characteristics were calculated with use of the configuration of the transmission line 1 illustrated in (a) of FIG. 2. In Example 1, the pin 18 is employed as the PWW-waveguide tube converting section. In Example 1, design parameters of the pin 18 were determined as follows:

Diameter: 180 μm

Length of the portion inserted into the substrate 12: 420 μm

Length of the portion protruding through the substrate 12: 700 μm

Example 2

Further, as Example 2 of the present invention, reflection characteristics and transmission characteristics were calculated with use of the configuration of the transmission line 1 illustrated in FIG. 3. In Example 2, the pin 118 is employed as the PWW-waveguide tube converting section.

Blind via 118*a*

Diameter: 100 μm

Length: 420 μm

Blind via 118*b*

Diameter: 100 μm

Length: 700 μm

Bumps B1 to B3

Diameter: 100 μm (Common Design Parameters)

Note that the design parameters common to both Example 1 and Example 2 were determined as follows:

Filter 11

Thickness of the substrate 12: 520 μm

Dielectric constant of the substrate 12: 3.82

Waveguide tube 21

Distance between the wide wall 221 and the wide wall 222: 1149 μm

Distance between the narrow wall 223 and the narrow wall 224: 2500 μm (Reflection Characteristics and Transmission Characteristics)

(a) of FIG. 4 is a graph showing reflection characteristics (frequency dependence of S11) and transmission characteristics (frequency dependence of S21) in Example 1. (b) of FIG. 4 is a graph showing reflection characteristics (frequency dependence of S11) and transmission characteristics (frequency dependence of parameter S21) in Example 2. In both (a) of FIG. 4 and (b) of FIG. 4, the symbol "S11" is given to a plot of the reflection characteristic, and the symbol "S21" is given to a plot of the transmission characteristics.

Referring to (a) of FIG. 4, the reflection characteristics, S11, in Example 1 is not more than −15 dB in a band of approximately not less than 71 GHz to not more than 88 GHz.

Referring to (b) of FIG. 4, the reflection characteristics, S11, in Example 2 is not more than −15 dB in a band of approximately not less than 73 GHz to not more than 90 GHz.

As described above, the transmission lines in Examples 1 and 2 achieved reduction of return loss over a wide band, in comparison to the transmission line provided with the conventional PWW-waveguide tube converting section with use of a coupling window.

Further, both Example 1 and Example 2, with return loss reduced over a wide band, exhibit favorable transmission characteristics over a wide band.

Embodiment 2

A transmission line in accordance with Embodiment 2 of the present invention will be described with reference to FIG. 5. (a) and (b) of FIG. 5 are each a cross-sectional view illustrating a transmission line 301 in accordance with Embodiment 2. (a) of FIG. 5 illustrates a cross-sectional view taking along a plane surface (z-x plane surface) that (i) includes a central axis of a pin 318, which is a columnar conductor constituting the PWW-waveguide tube converting section, and (ii) intersects a direction (y-axis direction) of propagation of electromagnetic waves. (b) of FIG. 5 illustrates a cross-sectional view taken along a plane surface (y-z plane surface) that (i) includes the central axis of the pin 318 and (ii) extends along the direction (y-axis direction) propagation of electromagnetic waves. (c) of FIG. 5 is a plan view illustrating the transmission line 301. (c) of FIG. 5 is a plan view illustrating the transmission line 301 when viewed in a plan view from below (from the z-axis negative direction side) and indicating a resin substrate 351 and an adhesive 361 with imaginary lines.

As illustrated in FIG. 5, the transmission line 301 includes a filter 311, a housing 341, and the resin substrate 351.

(Filter 311)

The filter 311 is obtained by modifying the filter 11 illustrated in FIGS. 1 and 2.

Specifically, the filter 11 is configured such that the blind via 19, which is the PWW-MSL converting section, extends from the side of the conductor layer 13, which is the first conductor layer, to the inside of the substrate 12 (see (b) of FIG. 2). In contrast, the filter 311 is configured such that a blind via 319, which is the PWW-MSL converting section, extends from the side of a conductor layer 314, which is the second conductor layer, to the inside of a substrate 312 (see (b) of FIG. 5).

As in the case of the conductor layer 13 illustrated in (b) of FIG. 2, the conductor layer 314 of the filter 311 has an opening 314*a* provided at a position corresponding to the blind via 319. Inside the opening 314*a*, a land 3141 is provided. The land 3141 is in electrical communication with the blind via 319.

The land 3141 of the filter 311 and the conductor layer 314 surrounding the land 3141 are an aspect of a planar transmission path, although providing a short transmission distance. That is, the land 3141 is an aspect of a signal line, and the conductor layer 314 is an aspect of a ground layer.

Thus, a planar transmission path included in a filter in accordance with an embodiment of the present invention may be placed on the conductor layer 13 side as in the filter 11 illustrated in FIGS. 1 and 2, or may be placed on the conductor layer 314 side as in the filter 311 illustrated in FIG. 5. The planar transmission path is a first planar transmission path recited in the claims.

Note that except for the above-described features, the filter 311 is configured similarly to the filter 11. Corresponding constituent members of the filter 311 in common with the filter 11 have reference symbols which are obtained by putting "3" in front of reference symbols for the filter 11. In Embodiment 2, descriptions of those constituent members will be omitted.

(Housing 341)

The housing 341 illustrated in FIG. 5 is made by forming, in a rectangular parallelepiped-shaped metal block, a tubular space 3211 rectangular in cross section and a recess 331 for accommodating the filter 311.

In FIG. 5, the housing 341 is placed on a resin substrate 351 (described later) such that a lengthwise direction of the metal block coincides with a y-axis direction of an orthogonal coordinate system illustrated in FIG. 5, and a height direction of the metal block coincides with a z-axis direction of the orthogonal coordinate system illustrated in FIG. 5.

Out of six side wall surfaces constituting the metal block, a y-z plane surface on a y-axis positive direction side has the rectangular parallelepiped-shaped tubular space 3211 which is dug in the y-axis positive direction. The tubular space 3211 functions as a waveguide tube 321 that guides electromagnetic waves in the y-axis direction in the same manner as the waveguide tube 21 illustrated in FIGS. 1 and 2.

In other words, as illustrated in (a) and (b) of FIG. 5, an upper wall 3221, a lower wall 3222, a left wall 3223, and a right wall 3224, all of which surround the sides of the tubular space 3211, constitute a tube wall 322 of the waveguide tube 321. Out of the walls defining the tubular space 3211, the wall along a z-x plane surface constitutes a short wall 323 of the waveguide tube 321. Thus, the upper wall 3221 and the lower wall 3222 form a wide wall of the waveguide tube 321. The left wall 3223, the right wall 3224, and the short wall 323 form a narrow wall of the waveguide tube 321.

Out of six side wall surfaces constituting the metal block, an x-y plane surface on a z-axis negative direction side has the rectangular parallelepiped-shaped recess 331 which is dug in the z-axis positive direction. The shape of an opening of the recess 331 corresponds to the shape of the substrate 312 of the filter 311. To allow the recess 331 to accommodate the filter 311, the filter 311 is pushed into the recess 331 through the opening of the recess 331 in the z-axis positive direction.

Note that a rim of the housing 341 around the recess 331 is referred to as skirt 342. To reliably accommodate the filter 311, the depth of the recess 331, i.e. the height of the skirt 342, is set to be greater than the thickness of the filter 311 (total thickness the substrate 312, the conductor layer 313, and the conductor layer 314).

As illustrated in (b) and (c) of FIG. 5, an opening 341*a* is provided at a boundary between a region of the tubular space 3211 on the y-axis negative direction side of the lower wall 3222, which is one of the members defining the tubular space 3211, and a region of the bottom surface of the recess 331 on the y-axis positive direction side. The tubular space 3211 and the recess 331 communicate with each other via the opening 341*a*.

In the filter 311, an end portion of the pin 318, which is a PWW-waveguide tube converting section, on the z-axis positive direction side is located inside the tubular space 3211 and placed inside the recess 331 such that the conductor layer 313 seals an opening 341*a*. Thus, in the opening 341*a*, a portion of the conductor layer 313 which portion seals the opening 341*a* functions as a portion of the lower wall 3222 of the waveguide tube 321.

According to this configuration, the pin 318 can electromagnetically couple a mode of propagating through the waveguide tube 321 and a mode of propagating through the filter 311. Since the opening 341*a* is sealed by the conductor layer 313, loss does not increase.

Further, the housing 341 is configured such that the whole of the filter 311 is accommodated inside the recess 331. Therefore, in comparison with a housing 441 (described later), which is a variation, the housing 341 can reliably protect the filter 311 (in particular, substrate 312) against an external impact. That is, the transmission line 301 has a high impact resistance in comparison with a transmission line 401 (described later).

(Resin Substrate 351)

The resin substrate 351 is configured such that the resin substrate 351 is capable of holding the filter 311 in a state in which the filter 311 is sandwiched between the resin substrate 351 and the housing 341. The resin substrate 351 is made of resin (made of glass epoxy resin in Embodiment 2). A resin material constituting the resin substrate 351 can be selected as appropriate in view of thermal expansion properties, processability, and the like.

On a surface of the resin substrate 351 on a side facing the filter 311 (on the z-axis positive direction side), a groove 355 in a shape corresponding to the skirt 342 is provided so that the skirt 342 can be put in the groove 355. The depth of the groove 355 is so set that the skirt 342 does not contact a bottom surface of the groove 355.

According to the above configuration, a surface of a part of the resin substrate 351 inside the groove 355 pushes the filter 311 in the z-axis positive direction. As a result, the conductor layer 313 of the filter 311 is pushed onto the bottom surface of the recess 331 of the housing 341. That is, the surface of the conductor layer 313 and the bottom surface of the recess 331 are in close contact with each other, and thus prevent generation of an air gap in an interface IF.

Thus, the housing 341 is adhered to the resin substrate 351 with an adhesive 361 made of a resin in a state in which the surface of the conductor layer 313 and the bottom surface of the recess 331 are in close contact with each other without any gap between them.

With the above configuration, the filter 311 is sandwiched between the housing 341 and the resin substrate 351. This prevents the filter 311 from being displaced inside the recess 331. In this way, the filter 311 and the waveguide tube 321 can be reliably held in proper positions in relation to each other. Thus, it is possible to prevent fluctuation of return loss that can occur at a coupling section between the filter 311 and the waveguide tube 321. Thus, the transmission line 301 can reliably broaden a band in which return loss is small, in comparison to the conventional transmission line.

Further, since it is possible to prevent generation of an air gap in the interface IF, it is possible to prevent electromagnetic waves having propagated through the waveguide tube 321 from entering the interface IF. Thus, it is possible to further reduce loss that can occur at the coupling section between the filter 311 and the waveguide tube 321.

Further, according to the above configuration, the waveguide tube 321 is integrally molded with the housing 341, and the filter 311 is firmly secured to the recess 331 of the housing 341. Thus, the transmission line 301 allows the waveguide tube 321 to be firmly coupled to the filter 311.

Note that, in the description in Embodiment 2, the adhesive 361 has been used as a joining member with which the housing 341 is joined to the resin substrate 351, However, the joining member is not limited to an adhesive and may be selected as appropriate from existing joining members such as a combination of a bolt and a nut.

Further, a conductor layer 352 and a land 3521 surrounded by the conductor layer 352 are provided on a surface of a portion of the resin substrate 351 which portion extends inward of the groove 355. In a state in which the filter 311 and the resin substrate 351 face each other, the land 3521 is provided at a position corresponding to the land 3141 which is surrounded by the conductor layer 314. The land 3521 is in electrical communication with the land 3141 with use of a bump B25 (an aspect of the electrically conductive connecting member).

The resin substrate 351 has a via 353 (conductor post recited in the claims) provided therein. The via 353 passes through the resin substrate 351 and brings the land 3521 and the signal line 354 into electrical communication with each other. The signal line 354 is a long narrow conductor provided on a surface of the resin substrate 351 on a side facing away from the filter 311 (surface on the z-axis negative direction side; also referred to as back surface) and surrounded by a ground layer (not illustrated in FIG. 5), which is constituted by a conductor layer, provided on the back surface of the resin substrate 351. Thus, the signal line 354, together with the ground layer, constitute a coplanar line (an aspect of a second planar transmission path). An end portion of the signal line 354 on a side facing away from the via 353 can be connected to an RFIC. Note that the planar transmission path is a second planar transmission path recited in the claims. Further, the signal line 354 of this planar transmission path is connected to the land 3141 via the via 353, the land 3521, and the bump B25.

With the configuration in which the blind via 319 of the filter 311 extends from the side of the conductor layer 314 to the inside of the substrate 312, it is possible to easily connect the RFIC to the surface (back surface) of the resin substrate 351, even in a case where an outer edge of the filter 311 is completely surrounded by the housing 341. Thus, it is not necessary to mount the RFIC on the surface of the filter 311 (on the surface of the conductor layer 313 or on the surface of the conductor layer 314). This makes it possible to increase the degree of freedom in the design of a transmission line.

Further, it is preferable that the conductor layer 314 is connected, via a plurality of bumps DB11 to DB15, DB21 to DB24, and DB31 to DB35, to the surface of the portion of the resin substrate which portion extends inward of the groove 355. The bumps DB11 to DB15. DB21 to DB24, and DB31 to DB35 are an aspect of a connecting member).

The land 3141 is connected to the land 3521 with use of the bump B25. Besides, the conductor layer 314 is connected, with use of the bumps DB11 to DB15, DB21 to DB24, and DB31 to DB35, to the conductor layer 352 which is provided on the surface of the resin substrate 351. This configuration achieves stronger connection, in comparison with the configuration in which the filter 311 and the resin substrate 351 are connected to each other by the bump B25 only.

Further, in a case where a material constituting the substrate 312 (quartz glass in Embodiment 2) and a material constituting the resin substrate 351 (glass epoxy resin in Embodiment 2) are different from each other, there is a concern that stress concentrates on the bump B25 due to different linear expansion coefficients of the different materials.

According to the above configuration, the filter 311 and the resin substrate 351 are connected to each other by the bumps DB11 to DB15, DB21 to DB24, and DB31 to DB35 as well as the bump B25. This makes it possible to prevent possible stress caused by a temperature change of an external environment from concentrating on the bump B25. Thus, it is possible to increase the reliability of the connecting member that connects the land 3141 and the land 3521.

[Variation 1]

A transmission line 401, which is a variation of the transmission line 301, will be described with reference to FIG. 6. Corresponding constituent members of the transmission line 401 in common with the transmission line 301 have reference symbols which are obtained by replacing the initial number "3" of reference symbols for the transmission line 301 by "4". In the present variation, only different features of the transmission line 401, as compared with the features of the transmission line 301, will be described, and the other features will be omitted.

A housing 441 included in the transmission line 401 is obtained by making shorter the longitudinal length (length along the y-axis direction) of the housing 341 which is included in the transmission line 301. In the housing 341, the recess 331 accommodates the whole of the filter 311. In contrast, the housing 441 is configured such that a recess 431 accommodates a region, of the filter 411, including a pin 418, which is a PPW-waveguide tube converting section. Thus, a region, of the filter 411, including a blind via 419, which is a PPW-planar transmission path converting section, is not accommodated by the housing 441, and is exposed to outside of the housing 441 (see FIG. 6).

The housing 441 is adhered to a resin substrate 451 with use of an adhesive 461. Further, it is preferable that the housing 441 is adhered to a conductor layer 413 of the filter 411 with use of the adhesive 462.

Further, in the case of the resin substrate 451 in accordance with Embodiment 2, a signal line 454 constituted by a log narrow conductor is provided on a surface of the resin substrate 451 on a side facing the filter 411 (surface on the z-axis positive direction side; referred to as front surface). The signal line 454 is surrounded by a ground layer that is constituted by the conductor layer 452 which is provided on the front surface of the resin substrate 451. Thus, the signal line 454, together with the conductor layer 452, constitute a coplanar line (an aspect of a second planar transmission path).

According to such a configuration, the RFIC can be mounted on the front surface of the resin substrate 451. Thus, the whole of the back surface of the resin substrate 451 can be secured by bringing the back surface into close contact with some kind of securing member or the like. This makes it possible to increase the degree of freedom in the design of a transmission line.

For the transmission line 401, to enhance protection performance of the filter 411, a configuration can alternatively be employed in which an exposed portion of the filter 411 outside the housing 441 is covered with a resin adhesive having a high hardness, such as an epoxy resin.

Note that even in a case where the transmission line 401 employs the housing 441, it is possible to mount the RFIC on the back surface of the resin substrate 451 by employing the configuration illustrated in (b) and (c) of FIG. 5.

Embodiment 3

An antenna device in accordance with Embodiment 3 of the present invention will be described with reference to FIG. 7. FIG. 7 is a cross-sectional view illustrating an antenna device 601 in accordance with Embodiment 3. FIG. 7 illustrates a cross-sectional view taken along a plane surface (y-z plane surface) that (i) includes the central axis of a pin 518, which is a PWW-waveguide tube converting section, and (ii) extends along the direction (y-axis direction) propagation of electromagnetic waves.

As illustrated in FIG. 7, the antenna device 601 includes a transmission line 501 and an antenna 571. The transmission line 501 is configured in substantially the same manner as the transmission line 301 illustrated in FIG. 5. However, a flange 542 is coupled to an end portion of the waveguide tube 521 on an open side (end portion on the y-axis positive direction side). In connection with this, the resin substrate 551 is cut so as to be flush with the end portion of the waveguide tube 521 on an open side.

The antenna 571 is configured so as to be capable of radiating electromagnetic waves in a band (e.g., E-band) in which the transmission line 501 is designed to be operated. A flange 572 is coupled to an end portion of the antenna 571 on a side facing away from the end portion thereof on the side which radiates electromagnetic waves.

The flange 542 and the flange 572 join the end portion of the waveguide tube 521 and the end portion of the antenna 571 to prevent the propagation region of electromagnetic waves from changing discontinuously. In Embodiment 3, the flange 542 and the flange 572 are joined with use of a joining member which is constituted by a bolt 581 and a nut 582. The joining member is not limited to a combination of a bolt and a nut, and may be selected as appropriate from existing joining members such as an adhesive. In a case where an adhesive is employed as the joining member, the adhesive preferably has electrical conductivity. Further, the flange 542 and the flange 572 may be welded.

The antenna device 601 produces the same effect as the effect produced by each of the transmission lines 1, 301, and 401 in accordance with embodiments of the present invention.

Aspects of the present invention can also be expressed as follows:

A transmission line (1, 301, 401, 501) in accordance with an embodiment of the present invention is a transmission line (1, 301, 401, 501), including: (A) a post-wall waveguide (11, 311, 411, 511) including a substrate (12, 312, 412) made of a dielectric, a pair of wide walls (13, 14, 313, 314, 413, 414) being constituted by a first conductor layer (13, 313, 413) and a second conductor layer (14, 314, 414), respectively, and covering respective opposite surfaces of the substrate (12, 312, 412), and narrow walls (16, 316) being constituted by post walls (161, 162, 163, 164) which are provided inside the substrate (12, 312, 412); and (B) a waveguide tube (21, 121, 321, 421, 521) including a tube wall (22, 122, 322, 422, 522) made of a conductor and being placed along the substrate (12, 319, 412).

The post-wall waveguide (11, 311, 411, 511) further includes: a planar transmission path including a ground layer which is a portion of the first conductor layer (13, 313, 413) or a portion of the second conductor layer (14, 314, 414); a converting section which converts between a mode of propagating through the planar transmission path and a mode of propagating through the post-wall waveguide (11, 311, 411, 511); and a first columnar conductor (18, 118, 318, 418, 518) passing through an opening (13*a*1) which is provided in the first conductor layer (13, 313, 413), the first columnar conductor (18, 118, 318, 418, 518) having one end portion (181, 118*a*1) located inside the substrate (12, 312, 412).

The waveguide tube (21, 121, 321, 421, 521) is placed such that the first columnar conductor (18, 118, 318, 418, 518) passes through an opening (22*a*, 122*a*, 341*a*) which is provided in the tube wall (22, 122, 322, 422, 522) and such that another end portion (182, 118*b*1, 3182) of the first columnar conductor (18, 318, 418, 518) is located inside the waveguide tube (21, 121, 321, 421, 521).

According to the above configuration, the post-wall waveguide and the waveguide tube are electromagnetically coupled to each other via the first columnar conductor passing through the opening which is provided in the first conductor layer, which constitutes one of the wide walls of the post-wall waveguide.

This columnar conductor can reduce return loss at a coupling section between the post-wall waveguide and the waveguide tube over a wide band, in comparison to a coupling window which couples a post-wall waveguide and a waveguide tube in the conventional transmission device. Thus, the transmission line in accordance with an embodiment of the present invention can broaden a band in which return loss is small, in comparison to the conventional transmission line.

Further, a transmission line (1) in accordance with an embodiment of the present invention is preferably configured such that the first columnar conductor (118) is divided into a first part (118*a*) and a second part (118*b*), the first part (118*a*) being embedded in the substrate (12) and having one end portion (118*a*2) which reaches a surface of the substrate (12), the second part (118*b*) protruding through the substrate (12), and the first part (118*a*) and the second part (118*b*) are connected to each other by an electrically conductive connecting member (B1).

The first columnar conductor of the transmission line in accordance with an embodiment of the present invention is divided into the first part and the second part, as described above. The first part, which is embedded in the substrate and has one end portion exposed to the surface of the substrate, can be formed by a method similar to a method of forming the post all. Then, by connecting the second part to the first part with use of the electrically conductive connecting member, the first columnar conductor is formed.

A transmission line in accordance with an embodiment of the present invention can be produced by such a production method. Thus, the transmission line in accordance with an embodiment of the present invention can be produced easily, in comparison with a transmission line including a columnar conductor which is constituted by a single member.

Further, a transmission line (1) in accordance with an embodiment of the present invention is preferably configured such that the second part (118*b*) is embedded in a block (119) made of a dielectric, and an end portion (118*b*2) of the second part (118*b*) on a side facing the first part (118*a*) reaches a surface of the block (119).

The above configuration allows the second part to be easily handled in connecting the second part to the first part. Thus, the transmission line in accordance with an embodiment of the present invention can be produced more easily, in comparison with a transmission line in which the second part is not embedded in the block.

Further, in a transmission line (1) in accordance with an embodiment of the present invention, the transmission line is a microstrip line, including: the ground layer (13); and a long narrow conductor (20*s*), provided on a surface of a dielectric layer (15), including one end portion (20*s*1) which at least is located inside a region surrounded by the post walls (161, 162, 163, 164), the dielectric layer (15) being provided on a surface of the ground layer. It is preferable that the converting section is a second columnar conductor (19) in electrical communication with the one end portion (20*s*1) of the long narrow conductor (20*s*), and the second columnar conductor (19) passes through an opening (13*a*2) provided in the ground and has one end portion (191) located inside the substrate (12).

Thus, the transmission line in accordance with an embodiment of the present invention preferably employs a microstrip line as a planar transmission path.

Further, a transmission line (301, 401, 501) in accordance with an embodiment of the present invention further includes: a housing (341, 441, 541) made of a metal, the housing including a tubular space (3211, 4211) and a recess (331, 431), the tubular space (3211, 4211) functioning as a propagation region of the waveguide tube (321, 421, 521), the recess (331, 431) accommodating at least a region including the first columnar conductor (318, 418, 518) of the post-wall waveguide (311, 411, 511); and a resin substrate (351, 451, 551) holding the post-wall waveguide (311, 411, 511) in a state in which the post-wall waveguide (311, 411, 511) is sandwiched between the resin substrate (351, 451, 551) and the housing (341, 441, 541), wherein the recess (331, 431) and the tubular space (3211, 4211) communicate with each other via an opening (341*a*) which is provided at a boundary between the recess (331, 431) and the tubular space (3211, 4211).

The post-wall waveguide (311, 411, 511) is preferably placed such that the another end portion (3182) of the first columnar conductor (318, 418, 518) is located inside the tubular space (3211, 4211), and the first conductor layer (313, 413) seals the opening (341*a*) which is provided at the boundary.

According the above configuration, the post-wall waveguide is sandwiched with use of the housing and the resin substrate. Thus, the post-wall waveguide and the waveguide tube can be reliably held in positions in relation to each other. Thus, it is possible to prevent fluctuation of return loss that can occur at a coupling section between the post-wall waveguide and the waveguide tube. Thus, the transmission line in accordance with an embodiment of the present invention can reliably broaden a band in which return loss is small, in comparison to the conventional transmission line.

Further, a transmission line (301) in accordance with an embodiment of the present invention is preferably configured such that a first planar transmission path, which is the planar transmission path of the post-wall waveguide (311), includes a portion of the second conductor layer (314) as a ground layer, the recess (331) of the housing (341) is provided so as to accommodate a whole of the post-wall waveguide (311), the resin substrate (351) further includes: a second planar transmission path which is provided on a surface, of opposite surfaces of the resin substrate (351), on a side facing away from the post-wall waveguide (311); and a conductor post (353) which passes through the resin substrate (351) and is in electrical communication with one end portion of the second planar transmission path, and the conductor post (353) of the resin substrate (351) is connected to the first planar transmission path by an electrically conductive connecting member (B25).

According to the above configuration, the second planar transmission path having one end portion connected to the first planar transmission path is provided on the surface of the resin substrate. Thus, in a case where a radio frequency integrated circuit (RFIC) is to be connected to another end portion of the second planar transmission path, the RFIC can be mounted on the surface of the resin substrate. Thus, it is not necessary to mount the RFIC on the surface of the post-wall waveguide. This makes it possible to increase the degree of freedom in the design of a transmission line.

Further, the above configuration, in which the housing accommodates the whole of the post-wall waveguide, can protect the post-wall waveguide against an external impact, in comparison with the configuration in which a part of the post-wall waveguide is exposed to the outside of the housing. That is, the transmission line in accordance with an embodiment of the present invention has a high impact resistance.

Alternatively, in a transmission line (401) in accordance with an embodiment of the present invention, a configuration may be employed in which a first planar transmission path, which is the planar transmission path of the post-wall waveguide (411), includes a portion of the second conductor layer (414) as a ground layer, the recess (431) of the housing (441) is provided such that the recess (431) accommodates a region, of the post-wall waveguide (411), including the first columnar conductor (418) and such that the first planar transmission path is exposed to an outside of the housing (441), the resin substrate (451) further includes a second planar transmission path which is provided on a surface, of opposite surfaces of the resin substrate (451), on a side facing the post-wall waveguide (411), and one end portion of the second planar transmission path is connected to the first planar transmission path by an electrically conductive connecting member (B25).

According to the above configuration, as in the case of the above-described transmission line, it is not necessary to mount the RFIC on the surface of the post-wall waveguide. This makes it possible to increase the degree of freedom in the design of a transmission line.

Further, according to the above configuration, the RFIC can be mounted on the surface, of the opposite surfaces of the resin substrate, on the side facing the post-wall waveguide. Thus, the whole of the surface of the resin substrate on a side facing away from the post-wall waveguide can be secured by bringing the surface into close contact with some kind of securing member or the like. Thus, it is possible to increase the degree of freedom in the design of a transmission line.

Further, a transmission line (301, 401) in accordance with an embodiment of the present invention is preferably configured such that the second conductor layer (314, 414) is connected to the surface of the resin substrate (351, 451) by a plurality of connecting members (DB11 to DB15, DB21 to DB24, and DB31 to DB35).

As described earlier, the first planar transmission path of the post-wall waveguide is connected to one end portion of the second planar transmission path with use of the electrically conductive connecting member. Besides, the second conductor layer of the post-wall waveguide is connected to the surface of the resin substrate with use of the plurality of connecting members. This configuration achieves stronger connection, in comparison with the configuration in which the post-wall waveguide and the resin substrate are connected to each other by the electrically conductive connecting member only.

Further, in a case where a material constituting the substrate of the post-wall waveguide and a material constituting the resin substrate are different from each other, there is a concern that stress concentrates on the electrically conductive connecting member due to different linear expansion coefficients of the different materials.

According to the above configuration, the post-wall waveguide and the resin substrate are connected to each other by the plurality of connecting members as well as the electrically conductive connecting member. This makes it possible to prevent possible stress caused by a temperature change of an external environment from concentrating on the electrically conductive connecting member. Thus, it is possible to increase the reliability of the connecting member that connects the first planar transmission path and the second planar transmission path.

Further, a transmission line (301, 401, 501) in accordance with an embodiment of the present invention is preferably configured such that a rim of the housing (341, 441, 541) around the recess (331, 431) is a skirt (342), a groove (355, 455) in a shape corresponding to the skirt (342) is provided on a surface of the resin substrate (351, 451, 551) on a side facing the post-wall waveguide (311, 411, 511), and the groove (355, 455) has a depth which is so set that the skirt (342) does not contact a bottom surface of the groove (355, 455).

According to the above configuration, any force of the resin substrate in a direction that moves the housing away from the surface of the resin substrate is not exerted on the skirt. Thus, it is possible to prevent generation of an air gap in between the first conductor layer of the post-wall waveguide and the bottom surface of the recess of the housing. This makes it possible to prevent electromagnetic waves having propagated through the inside of the tubular space, which functions as a waveguide tube, from entering the above-described air gap. Thus, it is possible to further reduce loss that can occur at the coupling section between the post-wall waveguide and the waveguide tube.

Further, an antenna device in accordance with an embodiment of the present invention preferably includes: a transmission line (501) in accordance with any one of the above-described aspects; and an antenna (571) coupled to an end portion of the waveguide tube (521) on a side which is open.

An antenna in accordance with an embodiment of the present invention produces the same effect as the effect produced by the transmission line in accordance with an embodiment of the present invention.

A post-wall waveguide (11, 311, 411, 511) in accordance with an embodiment of the present invention includes: a substrate (12, 312, 412) made of a dielectric; a pair of wide walls being constituted by a first conductor layer (13, 313, 413) and a second conductor layer (14, 314, 414), respectively, and covering respective opposite surfaces of the substrate (12, 312, 412); narrow walls (16, 316) being constituted by post walls (161, 162, 163, 164) which are provided inside the substrate (12, 312, 412); a planar transmission path including a ground layer which is a portion of the first conductor layer (13, 313, 413) or a portion of the second conductor layer (14, 314, 414); a converting section which converts between a mode of propagating through the planar transmission path and a mode of propagating through a region surrounded by the pair of wide walls (13, 14, 313, 314, 413, 414) and the narrow walls (16, 316); and a first columnar conductor (18, 118, 318, 418, 518) passing through an opening (13*a*1) which is provided in the first conductor layer (13, 313, 413), the first columnar conductor (18, 118, 318, 418, 518) having one end portion (181, 118*a*1) which is located inside the substrate (12, 312, 412) and another end portion (182, 118*b*1, 3182) which protrudes to an outside of the substrate (12, 312, 412).

According to the above configuration, with use of the waveguide tube having the tube wall provided with the opening, it is possible to easily couple the post-wall waveguide and this waveguide tube. Specifically, it is possible to couple the post-wall waveguide and the waveguide tube by passing the first columnar conductor through the opening provided in the tube wall of the waveguide tube and by placing the waveguide tube such that the another end portion of the first columnar conductor is located inside the waveguide tube.

The coupling section, provided in this way, between the post-wall waveguide and the waveguide tube can reduce return loss over a wide bandwidth, as in the case of the transmission line in accordance with an embodiment of the present invention.

Note that in the above section starting with "Aspects of the present invention can also be expressed as follows:", only members whose reference symbols are indicated in FIGS. 1 to 7 out of the members corresponding to the constituent components recited in the claims, are followed by their reference symbols in parentheses.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1, 301, 401, 501: Transmission line
11, 311, 411: Filter (post-wall waveguide; PWW)
12: Substrate
13, 313: Conductor layer (first conductor layer, wide wall)
131: Land
14, 314: Conductor layer (second conductor layer, wide wall)
15: Dielectric layer
16: Narrow wall
161, 162: Side wall
161*i*, 162*i*: Conductor post
163, 164: Short wall
171, 172, 173: Partition wall
171*a*, 172*a*, 173*a*: Coupling window
18, 118, 218: Pin (first columnar conductor)
181, 182: End portion of the pin
118*a*, 118*b*: Blind via
119: Block
120: Conductor layer
1201: Land
B1, B2, B3: Bump
19: Blind via (second columnar conductor)
191, 192: End portion of the blind via
20: MSL
20*s*: Signal line
20*g*1, 20*g*2: Ground pad
21, 321: Waveguide tube
22, 322: Tube wall
221, 922, 3221, 3222: Wide wall
223, 224, 3223, 3224: Narrow wall

23, 323: Short wall
331: Recess
341: Housing
351: Resin substrate
361: Adhesive
601: Antenna device
571: Antenna

The invention claimed is:

1. A transmission line, comprising: (A) a post-wall waveguide comprising a substrate made of a dielectric, a pair of wide walls being constituted by a first conductor layer and a second conductor layer, respectively, and covering respective opposite surfaces of the substrate, and narrow walls being constituted by post walls which are provided inside the substrate; and (B) a waveguide tube comprising a tube wall made of a conductor and being placed along the substrate, the post-wall waveguide further comprising:

a planar transmission path including a ground layer which is a portion of the first conductor layer or a portion of the second conductor layer;

a converting section which converts between a mode of propagating through the planar transmission path and a mode of propagating through the post-wall waveguide; and a first columnar conductor passing through an opening which is provided in the first conductor layer, the first columnar conductor having one end portion located inside the substrate, the waveguide tube being placed such that the first columnar conductor passes through an opening which is provided in the tube wall and such that another end portion of the first columnar conductor is located inside the waveguide tube.

2. The transmission line as set forth in claim 1, wherein the first columnar conductor is divided into a first part and a second part, the first part being embedded in the substrate and having one end portion which reaches a surface of the substrate, the second part protruding through the substrate, and the first part and the second part are connected to each other by an electrically conductive connecting member.

3. The transmission line as set forth in claim 2, wherein the second part is embedded in a block made of a dielectric, and an end portion of the second part on a side facing the first part reaches a surface of the block.

4. The transmission line as set forth in claim 1, wherein the transmission line is a microstrip line, including: the ground layer; and a long narrow conductor, provided on a surface of a dielectric layer, including one end portion which at least is located inside a region surrounded by the post walls, the dielectric layer being provided on a surface of the ground layer, the converting section is a second columnar conductor in electrical communication with the one end portion of the long narrow conductor, and the second columnar conductor passes through an opening which is provided in the ground layer, the second columnar conductor having one end portion located inside the substrate.

5. The transmission line as set forth in claim 1, further comprising:

a housing made of a metal, the housing including a tubular space and a recess, the tubular space functioning as a propagation region of the waveguide tube, the recess accommodating at least a region including the first columnar conductor of the post-wall waveguide; and a resin substrate holding the post-wall waveguide in a state in which the post-wall waveguide is sandwiched between the resin substrate and the housing, wherein the recess and the tubular space communicate with each other via an opening which is provided at a boundary between the recess and the tubular space, and the post-wall waveguide is placed such that the another end portion of the first columnar conductor is located inside the tubular space, and the first conductor layer seals the opening which is provided at the boundary.

6. The transmission line as set forth in claim 5, wherein a first planar transmission path, which is the planar transmission path of the post-wall waveguide, includes a portion of the second conductor layer as a ground layer, the recess of the housing is provided so as to accommodate a whole f the post-wall waveguide, the resin substrate further includes: a second planar transmission path which is provided on a surface, of opposite surfaces of the resin substrate, on a side facing away from the post-wall waveguide; and a conductor post which passes through the resin substrate and is in electrical communication with one end portion of the second planar transmission path, and the conductor post of the resin substrate is connected to the first planar transmission path by an electrically conductive connecting member.

7. The transmission line as set forth in claim 6, wherein the second conductor layer is connected to the surface of the resin substrate by a plurality of connecting members.

8. The transmission line as set forth in claim 5, wherein a first planar transmission path, which is the planar transmission path of the post-wall waveguide, includes a portion of the second conductor layer as a ground layer, the recess of the housing is provided such that the recess accommodates a region, of the post-wall waveguide, including the first columnar conductor and such that the first planar transmission path is exposed to an outside of the housing, the resin substrate further includes a second planar transmission path which is provided on a surface, of opposite surfaces of the resin substrate, on a side facing the post-wall waveguide, and one end portion of the second planar transmission path is connected to the first planar transmission path by an electrically conductive connecting member.

9. The transmission line as set forth in claim 5, wherein a rim of the housing around the recess is a skirt, a groove in a shape corresponding to the skirt is provided on a surface of the resin substrate on a side facing the post-wall waveguide, and the groove has a depth which is so set that the skirt does not contact a bottom surface of the groove.

10. An antenna device comprising:

a transmission line recited in claim 1; and an antenna coupled to an end portion of the waveguide tube on a side which is open.

11. A post-wall waveguide, comprising:

a substrate made of a dielectric;

a pair of wide walls being constituted by a first conductor layer and a second conductor layer, respectively, and covering respective opposite surfaces of the substrate;

narrow walls being constituted by post walls which are provided inside the substrate;

a planar transmission path including a ground layer which is a portion of the first conductor layer or a portion of the second conductor layer;

a converting section which converts between a mode of propagating through the planar transmission path and a mode of propagating through a region surrounded by the pair of wide walls and the narrow walls; and a first columnar conductor passing through an opening which is provided in the first conductor layer, the first columnar conductor having one end portion which is located inside the substrate and another end portion which protrudes to an outside of the substrate.

* * * * *